US005651150A

United States Patent [19]

Kanitzer et al.

[11] Patent Number: 5,651,150

[45] Date of Patent: Jul. 29, 1997

[54] MOBILE PATIENT SUPPORT SYSTEM

[75] Inventors: Dieter Kanitzer, Rastatt; Carl-Christian Bastert, Gaggenau; George Marx, Weingarten, all of Germany

[73] Assignee: Maquet AG, Rastatt, Germany

[21] Appl. No.: 631,268

[22] Filed: Apr. 12, 1996

[30] Foreign Application Priority Data

Apr. 18, 1995 [DE] Germany ..... 195 14 305.1

[51] Int. Cl.[6] ..... A47C 19/00

[52] U.S. Cl. ..... 5/600; 5/86.1; 403/327

[58] Field of Search ..... 5/600, 86.1, 83.1, 5/81.1, 611; 403/326, 327

[56] References Cited

U.S. PATENT DOCUMENTS 4,577,570 3/1986 Hannant ..... 5/86.1
5,083,331 1/1992 Schnelle ..... 5/600

FOREIGN PATENT DOCUMENTS 2525702 10/1983 France ..... 5/600
15413341 9/1969 Germany ..... 5/86.1

*Primary Examiner*—Flemming Saether

[57] ABSTRACT

A structure providing a patient support surface is transferable between a stationery support column and a wheeled transport carriage with the transport carriage, the support column and the support surface providing structure having connecting parts which cooperate to securely hold the structure to the transfer carriage or to the support column when the structure is mounted on the transfer carriage or the support column, the connecting parts during transfer of the structure from the transfer carriage to a support column, or vice versa, being automatically moved between latched and unlatched conditions to allow the transfer to occur and having security features preventing the patient support surface providing structure from being inadvertently unfastened from both the support column and the transport carriage during a transfer procedure.

1 Claim, 6 Drawing Sheets

MOBILE PATIENT SUPPORT SYSTEM

FIELD OF THE INVENTION

The invention concerns a structure, for use in an operating room or other patient care facility, providing a patient support surface in combination with one or more support columns and a wheeled transport carriage for moving the support surface providing structure from one location to another and for transferring the structure to and from the transport carriage and to and from a support column; and deals more particularly with improvements in the connecting parts on the transport carriage, on the support column and on the support surface providing structure which securely hold the support surface providing structure to the transfer carriage or to the support column and which connecting parts during the transfer of the patient support providing structure from the transfer carriage to a support column, or vice versa, are automatically moved between latched and unlatched conditions to allow the transfer to occur.

BACKGROUND OF THE INVENTION

Such a mobile patient support system is known from EP 0 457 246.

The invention has as its object the increasing of the functional security of known mobile patient support systems.

SUMMARY OF THE INVENTION

The above-mentioned object is solved in accordance with the invention in that the portion of a latching pawl intended for reception in the detent recess of an associated pin receiver has two arresting ledges at different spacings from the pivot axis of the pawl, in that the control surface of each pin receiver is formed with a control dog, and in that on the portion of the latching pawl intended to engage the control surface of the pin receiver, a control curve is formed intended for cooperation with the control dog and with the control surface, the position and shape of the control dog and of the control curve being so designed, that upon a relative movement of the connecting element relative to the two pin receivers of the support column and of the transport carriage, when in their transfer position, the pawl is pivoted a fractional amount of its maximum pivot angle and moves into the associated detent recess by means of its arresting ledge lying closer to the pawl pivot axis, while its arresting ledge located further from the pawl pivot axis upon a movement of the pin receivers of the support column and transport carriage relative to one another moves latchingly into the detent recess in the pin receiver of the component (transport carriage, support column) taking on the support surface means.

When the pin receivers of the support column and the transport carriage are in their transfer position, the two pawls of the two connecting elements are in their unlatched positions. With the solution of the invention, in this situation the patient support surface means is prevented from being able to be taken from or unintentionally loosened from the support column and the transport carriage. At this moment, if an attempt is made to lift the support surface means so that the connecting elements on the patient support surface means move relative to the pin receivers on the support column and on the transport carriage which remain in their transfer position, the latching pawls through the cooperation of the control dogs with the control curves formed on the latching pawls are so controlled that the pawls are partially pivoted and move into latching relationship with the detent recesses by means of the arresting ledges lying closer to the pawl pivot axes. The same thing happens if, for example, the patient support surface means is tilted. In this situation at least one of the latching pawls also latches, with its arresting ledge closer to the pawl pivot axis, into the adjacent detent recess so that the patient support surface means cannot be unintentionally loosened from the supporting component.

Further features and advantages of the invention will be apparent from the following description, which in connection with the accompanying drawings, explains the invention by way of an exemplary embodiment.

BRIEF DESCRIPTION OF THE DRAWINGS

The drawings are:

FIG. 8*b*—a left side view of the latching pawl of FIG. 8*a*.

FIG. 8*c*—a front view of the latching pawl of FIG. 8*a*.

DESCRIPTION OF THE PREFERRED EMBODIMENT

Figure 1B:
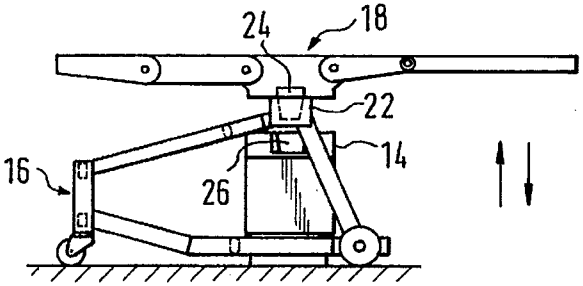
FIGS. 1*a*, 1*b*, 1*c*, 1*d*, 1*e*, 1*f* and 1*g*—schematic sketches for explaining the functioning of the mobile patient support system.
Figure 1D:
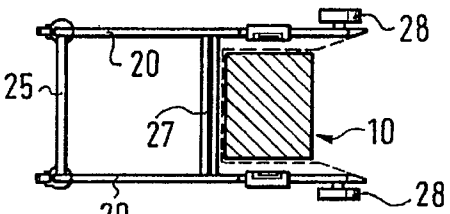
Figure 1G:
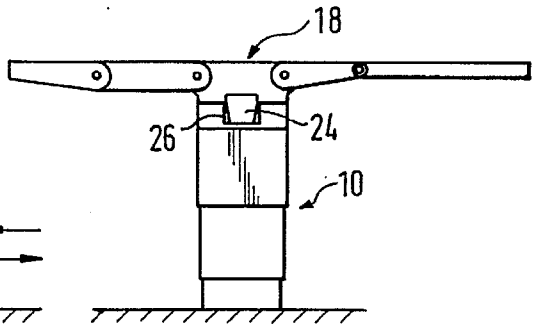
Figure 1A:
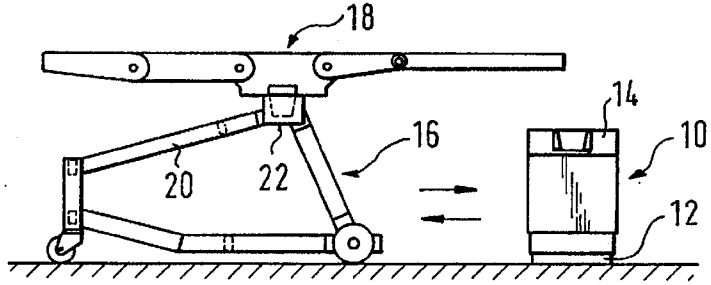
Figure 1C:
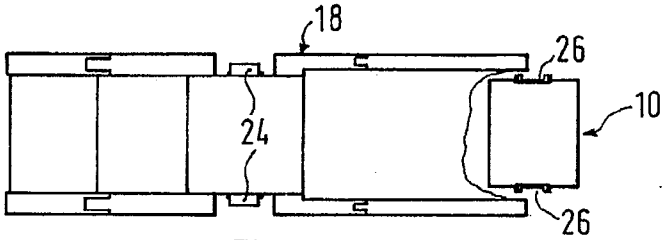

In FIG. 1*a* is seen an operating table support column, indicated generally at 10, with a column foot 12 and a column head 14, which head is adjustable in height and supported on the column foot. The height adjusting mechanism is not illustrated. It can be made in any customary way, and as a rule is an hydraulic or mechanical reciprocating device.

To the left next to the supporting column is a transport carriage, indicated generally at 16, carrying a patient support surface means or table plate 18 of the operating table. The transport carriage 16 is made of two side frame portions 20 connected to one another by transverse spars (FIG. 1*d*). The transverse spars 25,27 are located in a middle region so that the space between the side frame portions 20, from the wheels 28 at the right end of the transport carriage in FIG. 1 to the transverse spars 25,27, is freely accessible. Thus the transport carriage can be moved to the support column 10 so that the support column becomes positioned between the frame portions 20 of the transport carriage, as seen in the schematic plan view of FIG. 1*d* wherein the support column is illustrated in broken lines.

On the upper ends of the somewhat non-symmetrically shaped side frame portions 20 are formed pin receivers 22 adapted for the reception of pin-like connecting elements 24 arranged on the longitudinal side edges of the table plate 18 and which extend downwardly from the table plate 18. The exact form of the connecting elements will be explained in more detail in connection with the other figures. On two oppositely directed sides of the column head 14 are likewise arranged pin receivers 26 so that they, in the position of the transport carriage 16 relative to the support column 10 illustrated in FIG. 1*d*, lie opposite to the pin receivers 22 of the transport carriage.

For the transfer of the table plate or support surface means 18 from the transport carriage 16 to the support column 10, the transport carriage 16 is moved to the position relative to the support column 10 illustrated in FIG. 1*b*. In this position, the connecting elements 24 stand exactly above the pin receivers 26 on the column head 14. Next the column head 14 is lifted by the lifting apparatus inside of the column until the connecting elements 24 on the support surface means 18 are moved entirely into the pin receivers 26 on the column head 14. At this moment, the connecting elements 24 are received at the same time in the pin receivers 22 of the transport wagon 16 and in the pin receivers 26 of the column head 14.

Figure 1F:
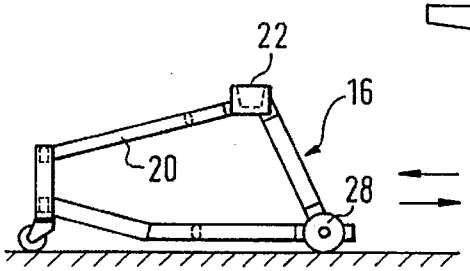
Figure 1E:
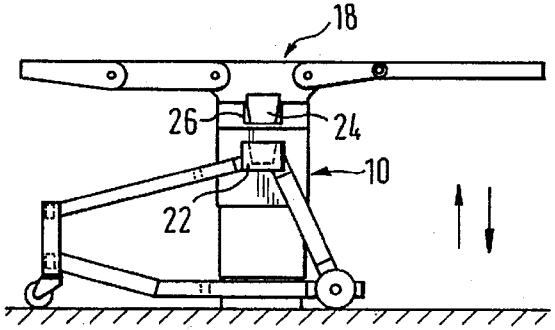

Now, in accordance with FIG. 1*e*, the column head 14 is further lifted until the support surface means 18 as to its connecting elements 24 is lifted out of the pin receivers 22 of the transport carriage. The transport carriage can now be removed (FIG. 1*f*). The operating table can then in the customary way, according to need, be adjusted to the desired working height (FIG. 1*g*). In the transfer of the support surface means from the support column 10 to the transport carriage 16, a reverse procedure is carried out.

The support surface means 18 must be latched onto the support column 10 as well as onto the support carriage 16 in order to prevent an unintended release of the support surface means from the particular support component being used at the time. How this latching and unlatching during the transfer of the support surface means from the support column 10 to the transport carriage 16, or the reverse, takes place will now be described in more detail with reference to the further figures.

Figure 4:
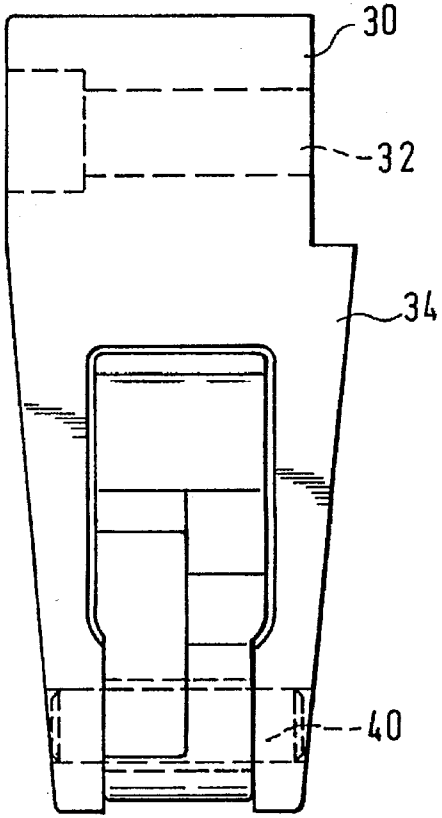
FIG. 4—a front view of a connecting element taken in the direction of the arrow A of FIG. 3.
Figure 3:
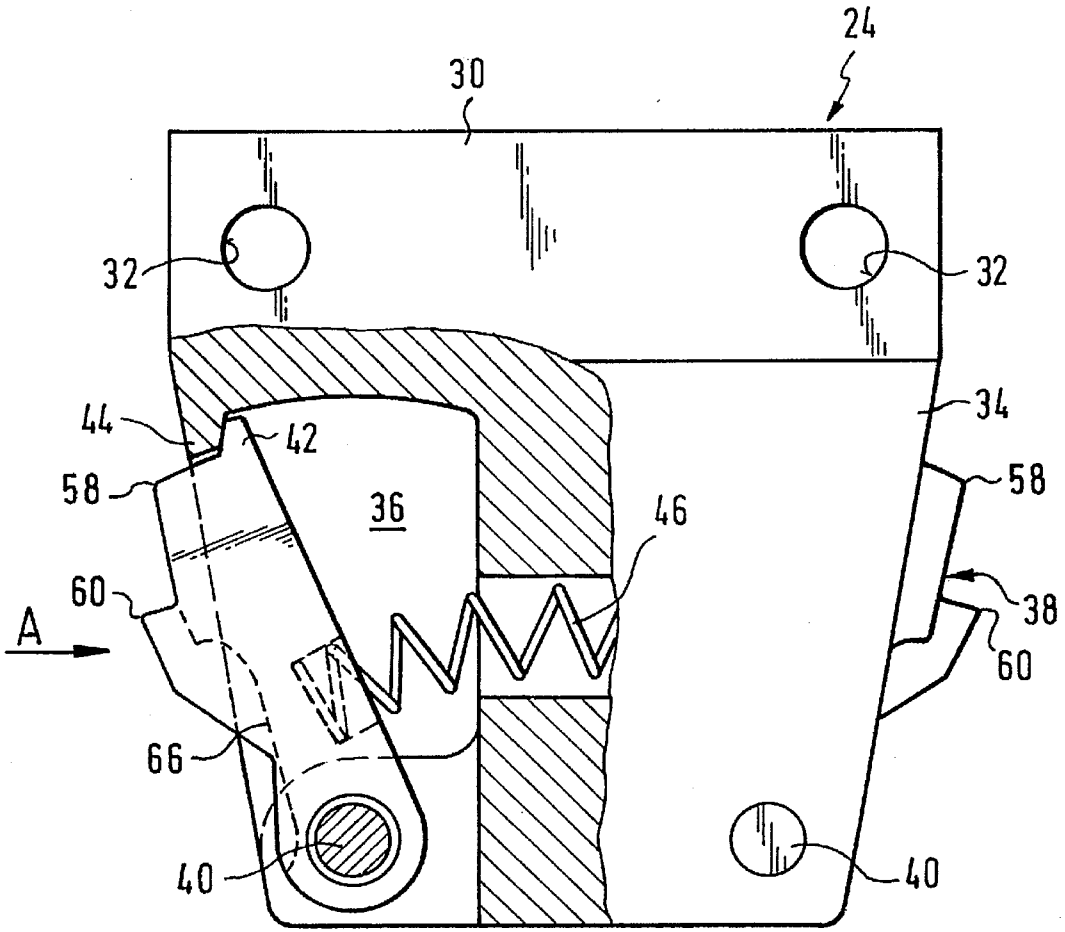
FIG. 3—a partially sectional illustration in side view of a connecting element.

The connecting elements 24 are shown in more detail in FIGS. 3 and 4. Each connecting element 24 includes a rectangular flange portion 30 with holes 32, through which holes bolts can be inserted for fastening the connecting element 22 to the support surface means 18. A trapezoidal base body 34 is connected integrally with the flange portion 30, which base body 34 in progressing away from the flange portion diminishes as seen both in side view and in front view, as shown in FIGS. 3 and 4. The base body has on its face or small sides, two fork-like recesses 36 respectively, in each of which a pawl 38 is pivotally supported for movement about an axis 40. The pawl 38 has on its inwardly lying upper edge a stop 42 which prevents the outward pivoting of the pawl from the fork-shaped recess 36 by engagement with a counterstop 44 of the base body 34, as can be seen in FIG. 3. Both pawls 38 are biased toward their outwardly pivoted positions by a helical compression spring 46 working between them.

Figure 2:
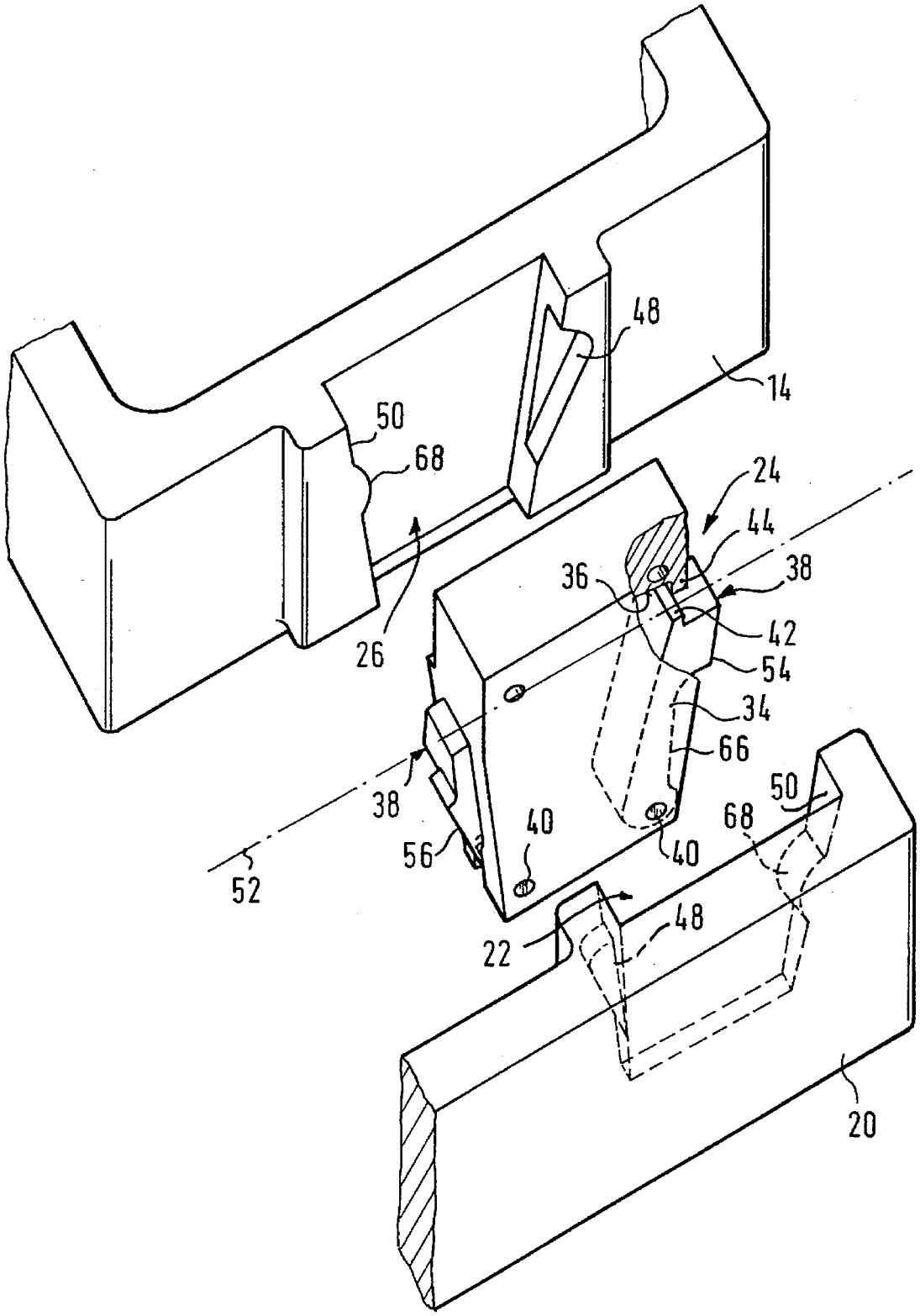
FIG. 2—a partially schematic perspective fragmentary illustration of a connecting pin element and of the associated pin receivers on the support column and on the support carriage.

The pin receivers 22 on the transport carriage and the pin receivers 26 on the column head 14 are formed identically (FIG. 2). They are suited in their shapes to the base bodies of the connecting elements 24, and each is adapted to surround a connecting element, however, only half way. The two open pin receivers 22 and 26 shown in FIG. 2 together form, with their open sides facing one another, a recess which entirely surrounds the associated connecting element 24. It is essential, however, that each pin receiver only on one of the side surfaces facing the front surfaces of the connecting element 22 has a pawl receiving or detent recess 48 while the other side face 50 is smooth and forms a control surface.

If the illustrated connecting element is inserted into the pin receiver 26 of the column head (FIG. 2), the latching pawl 38 lying to the right in the figures can move into the associated detent recess 48. The left lying latching pawl 38 of these figures is pressed against the smooth control surface 50 by the force of the helical compression spring 46 in the base body 34 of the connecting element 24. It is to be noted that the pawls in the direction of their axes extend only half way into the pin receiver 26 of the column head. The plane normal to the axes up to which the connecting element 24 is received in the pin receiver 26 on the column head 14 is illustrated in FIG. 2 at 52.

Figure 7:
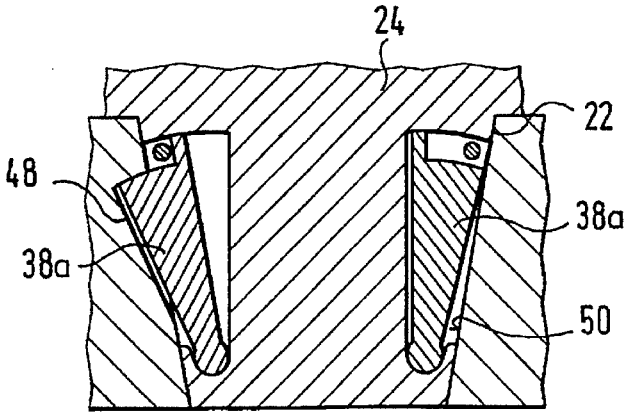
Fig. 7 PRIOR ART
FIG. 7—an illustration corresponding to FIG. 5 of the prior art connecting element latched into the pin receiver of the transport carriage.

FIG. 7 illustrates the way in which the connecting element 24 of a prior art device is received in the pin receiver 22 of the transport carriage 16. Here the left-lying latching pawl 38*a* moves into the provided detent recess 48 while the right latching pawl 38*a* is pressed by the smooth control surface 50 inwardly into the base body 34 of the connecting element 24. From the illustrations of FIGS. 5 and 7, it can be seen that the support surface means 18 is latched and thereby secured onto the column head 14 when supported by the column head, and is also latched and secured onto the support carriage 16 when supported by the support carriage.

Figure 6A:
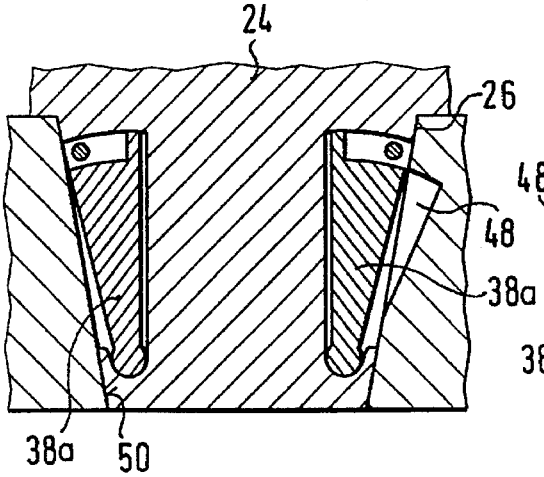
Fig. 6a PRIOR ART
FIG. 6*a*—an illustration corresponding to FIG. 5 of the prior art connecting element, but showing the condition of the connecting element relative to the pin receiver of the support column when the connecting element is received simultaneously in both the pin receiver of the support column and in the pin receiver of the transport carriage.
Figure 6B:
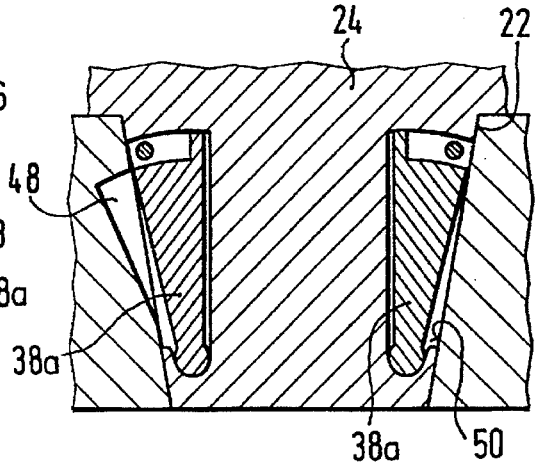
Fig. 6b PRIOR ART
FIG. 6*b*—an illustration similar to FIG. 6*a*, but showing the condition of the prior art connecting element relative to the pin receiver of the transfer carriage when the connecting element is received simultaneously in both the pin receiver of the support column and in the pin receiver of the transport carriage.

During the transfer on the other hand, there arises a condition at which the connecting element 24 is received simultaneously in the pin receiver 22 of the transport carriage 16 and in the pin receiver 26 of the column head 14. This condition is illustrated in FIGS. 6*a* and 6*b*. FIG. 6*a* shows the condition with respect to the column 10 and FIG. 6*b* with respect to the transport carriage 16.

Each of the pawls 38*a* lies against one control surface 50. More particularly, the left pawl 38*a* lies on the control surface 50 of the pin receiver 26 of the column head 14 and the right pawl 38*a* lies on the control surface 50 of the pin receiver 22 of the transport carriage 16, so that both pawls 38*a* are pressed into the base body 34 of the connecting element 24 and are thereby unlatched. This can be seen at the right side of FIG. 6*a* and on the left side of FIG. 6*b*. This unlatching takes place automatically at the moment at which the pin recesses 22,26 of the column head 14 and of the transport carriage 16 are at the same height. If now the column head 14 is lowered from this position relative to the transport carriage 16, the transport carriage takes on the support surface means 18, the left pawl 38*a* in FIG. 6*b* can latch into the provided detent recess 48 of the pin receiver 22 on the transport carriage 16 and thereby secure the support surface means 18 to the transport carriage. In the reverse situation, if the column head 14 proceeding from the position illustrated in FIG. 6*a* is lifted from the transport carriage 16 to take on the support surface means 18, then the right pawl 38*a* moves free of the control surface 50 and can latch into the right lying detent recess 48 of the pin receiver 26 on the column head 14. Therefore, in this case also the support surface 18 is automatically latched onto the column head 14.

Figure 5:
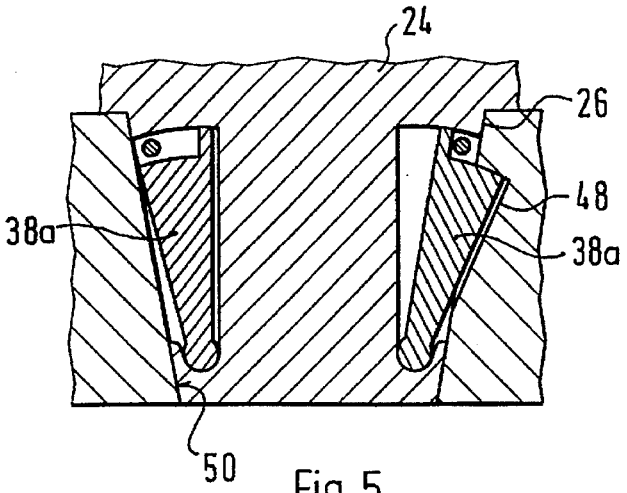
Fig. 5 PRIOR ART
FIG. 5—a schematic sectional view illustrating one of the connecting elements, made in accordance with the prior art, latched into the pin receiver of the support column.

In FIGS. 5 to 7 the latching pawls 38*a* are only schematically illustrated in order to explain their basic function during the transfer of the patient support surface means from the support column 10 to the transport carriage 16, or the reverse. From the illustrated transfer position of FIGS. 6*a* and 6*b*, in which the pin receivers 22,26 of the support column 10 and the transport carriage 16 are at the same height, the connection elements 24 can be lifted out of the pin receivers 26 and 22 of the support column 10 and of the transport carriage 16. In order to prevent this, and in accordance with the invention, the latching pawls 38 and the control surfaces 50 are formed in a special way which will now be explained in more detail in connection with FIGS. 8 to 10.

Figure 8A:
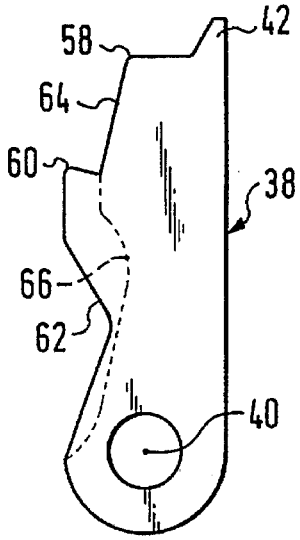
FIG. 8*a*—a right side view of a latching pawl.
Figure 8C:
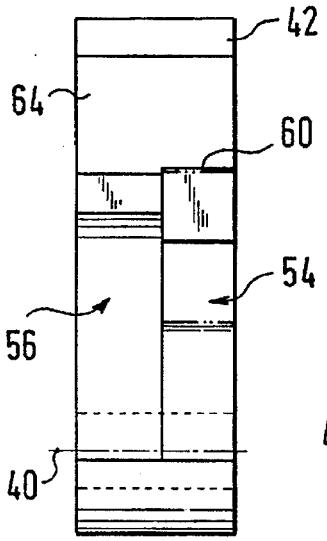
Figure 8B:
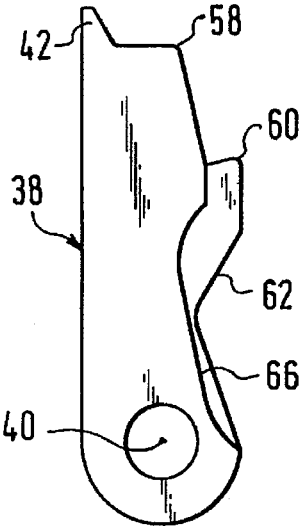

FIGS. 8*a* and 8*b* show respectively a left and a right side view of a latching pawl 38, while FIG. 8*c* shows a view of the outer or forward side of the latching pawl 38 with the direction of view being perpendicular to the pivot axis of the pawl. Each latching pawl 38 has mutually on the two sides of the plane 52, illustrated in FIG. 2 and perpendicular to the pawl pivot axis 40, an arresting or latch portion 54 and a control portion 56 (FIGS. 2 and 8*c*). The two portions 54,56 are identical at their upper head portion. On this upper head portion is formed a first arresting ledge 58 with which the pawl 38 is received in the associated detent recess 48 when the connecting element 24 is connected with the support column 10 or with the transport carriage 16.

The arresting portion 54 moreover has a second arresting ledge 60 having a shorter radial spacing from the pawl pivot axis than the first arresting ledge 58. Further, as seen in FIGS. 8*a* and 8*b*, the arresting portion 54 further is provided with a triangular shaped recess 62 which makes possible a pivoting of the pawl 38 in question into the detent recess 48 as can be appreciated by reference to FIG. 9.

The control portion 56 has, proceeding from the first arresting ledge 58, an essentially straight section 64 and a control curve 66 with an inwardly curved transition curve whose form is seen in FIGS. 8*a* and 8*b*.

On the associated control surfaces 50 of the pin receivers 26 and 22 of the support column 10 and of the transport carriage 16, a knuckle shaped control dog 68 is formed which is intended for cooperation with the control portion 56 of the associated latching pawl 38.

Figure 9:
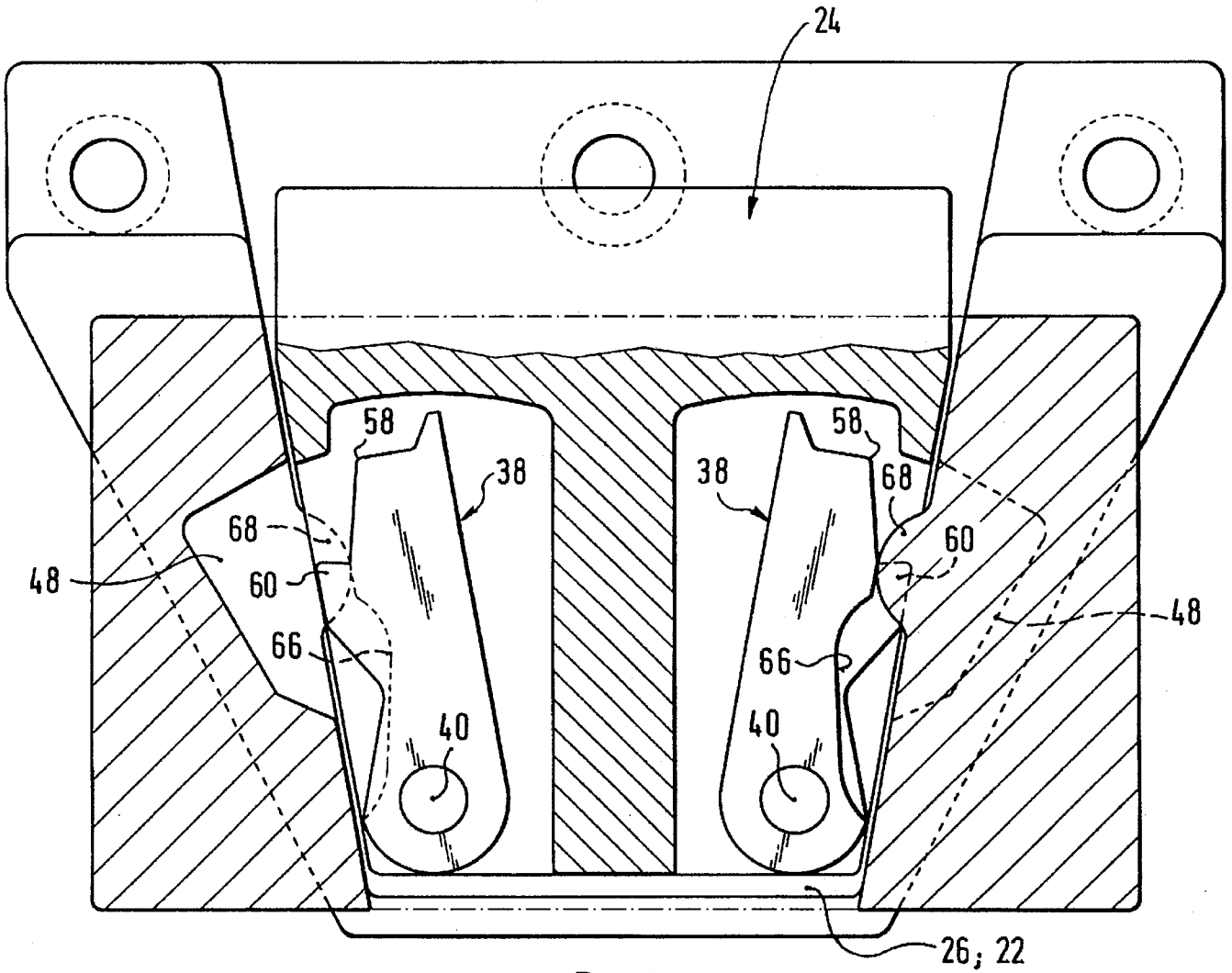
FIG. 9—a schematic side view showing a connecting element simultaneously received by the pin receiver on the column and the pin receiver on the transport carriage with the pin receivers being in their transfer positions relative to one another.

FIG. 9 shows in schematic way the pin receivers 22 and 26 in their transfer position in which their contours are entirely covered. From this figure it is to be taken that, as in the illustration of FIG. 2, the left detent recess 48 in FIG. 9 and the right control dog 68 of FIG. 9 belong to the pin receiver 22 of the transport carriage 16, while the right detent recess 48 of FIG. 9 and the left control dog 68 of FIG. 9 belong to the pin receiver 26 on the support column 10. The connecting element 24 is entirely received in the two pin receivers 22 and 26, so that both latching pawls 38 are pivoted to their unlatching positions. Functionally, therefore, the illustration of FIG. 9 corresponds to the situation illustrated by FIGS. 6*a* and 6*b*. As can be seen in FIG. 9, the two pawls 38 are pivoted to their unlatched positions because of the associated control dogs 68 lying against the essentially straight line parts of the control portions 56 of the pawls 38. The arresting portion 54 of each pawl is therefore located entirely outside of the contour of the associated detent recess 48.

Figure 10:
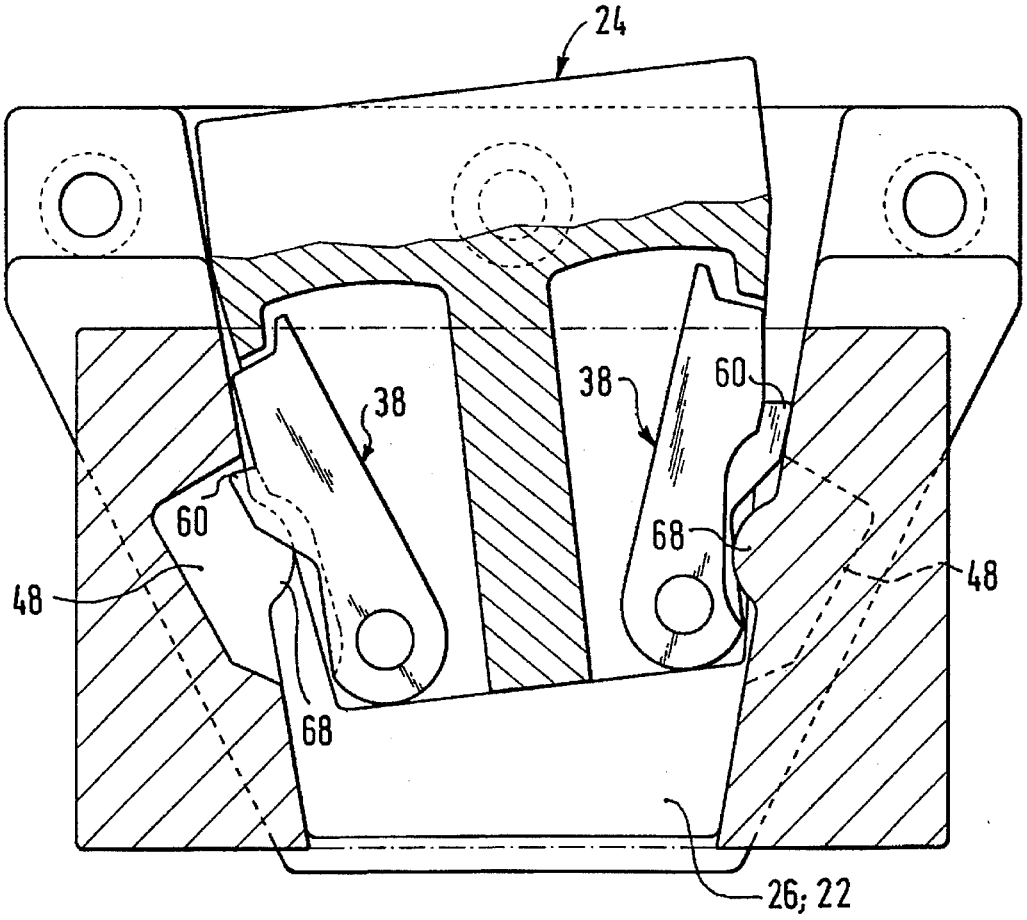
FIG. 10—a view corresponding to FIG. 9 wherein the connecting element is lifted and tilted.

As can be seen in FIGS. 6*a* and 6*b*, upon a lifting of the connecting element 24 out of the pin receivers 22 and 26 in which it remains while in their transfer position, the latching pawls 38 there shown cannot move into their associated detent recesses 48, since the upper edges of the associated locking portions, corresponding to the first arresting ledges 58 on the latching pawls 38 according to the invention, are immediately moved out of the contours of the associated detent recesses 48. In contrast to this, in the inventive solution if the connecting element 24 is lifted upwardly from the two pin receivers 22,24 which are in their transfer position, or is tilted, as shown in FIG. 10, then because of the shape and position of the control dogs 68 and of the control curves 66 at least one pivotal pawl 38 can be pivoted so far outwardly that its second arresting ledge 60 moves latchingly into the associated detent recess 48, as illustrated in the left half of FIG. 10, so that a further pulling out of the connecting element 24 from the pin receivers 22,26 is prevented. This arrangement, therefore, prevents the support surface means 18 from being taken from the support column 10 and the transport carriage 16, or from being unintentionally loosened, at the moment of transfer of the support surface means 18 from the support column 10 to the transport carriage 16, or the reverse. Thereby the security of the mobile patient support system is further increased.

We claim:

1. A mobile patient support system, including a patient support surface means, a first component in the form of a support column for supporting the support surface means and a second component in the form of a transport carriage for transporting the support surface means, said support surface means through relative movement between the transport carriage and the support column being transferable from the support column to the transport carriage, and the reverse, said support surface means having arranged thereon at least two pin shaped connecting elements insertable into complementary pin receivers on the support column and on the transport carriage for connecting the support surface means to the support column and to the transport carriage, two latching pawls pivotally supported on each of said connecting elements and each of which bawls is movable relative to its associated connecting element about a pivot axis between a latching position and an unlatching position, each of said connecting elements during a transfer procedure being received simultaneously in a column associated pin receiver and a transport carriage associated pin receiver, each of said pin receivers having formed therein a detent recess for receiving one of said two latching pawls in its latching position and a control surface associated with the other of said two latching pawls, said control surface upon insertion of the connecting element shifting the associated latching pawl to its unlatched position, each of said two latching pawls having two portions, one of said two portions being intended for reception in the detent recess of a pin receiver of one of said first and second components and the other of said two portions being intended for engagement with the control surface of the pin receiver of the other of said first and second components, characterized in that the portion of each of said latching pawls intended for reception in the detent recess of the associated pin receiver has two arresting ledges, the first of said two arresting ledges being spaced from the pivot axis of the pawl and the second of said two arresting ledges being spaced farther from the pivot axis of said pawl than said first arresting ledge,, a control dog is formed on the control surface of each pin receivers on the portion of the latching pawl intended for engagement with the control surface of the pin receiver a control curve is formed for cooperation with the control dog and with the control surface, and the location and shape of the control dog and of the control curve is so designed that upon an inadvertent relative movement of the connecting element relative to both of the two associated pin receivers of the support column and of the transport carriage during a transfer procedure the latching pawl is pivoted a partial amount of its maximum pivot angle and is moved into the detent recess with said first arresting ledge and so that upon a movement of the two associated pin receivers relative to one another during a transfer procedure, said second arresting ledge moves latchingly into the detent recess in the pin receiver of the component taking on the support surface means.

* * * * *